US010976007B2

(12) United States Patent
Karlsson et al.

(10) Patent No.: US 10,976,007 B2
(45) Date of Patent: Apr. 13, 2021

(54) FUEL TANK ARRANGEMENT OF A MARINE VESSEL

(71) Applicant: WÄRTSILÄ FINLAND OY, Vaasa (FI)

(72) Inventors: Sören Karlsson, Solf (FI); Frank Harteveld, Drunen (NL); Frans Launonen, Vaasa (FI); Piero Zoglia, Vaasa (FI)

(73) Assignee: WÄRTSILÄ FINLAND OY, Vaasa (FI)

( * ) Notice: Subject to any disclaimer, the term of this patent is extended or adjusted under 35 U.S.C. 154(b) by 209 days.

(21) Appl. No.: 15/762,489

(22) PCT Filed: Sep. 28, 2015

(86) PCT No.: PCT/FI2015/050644
§ 371 (c)(1),
(2) Date: Mar. 22, 2018

(87) PCT Pub. No.: WO2017/055674
PCT Pub. Date: Apr. 6, 2017

(65) Prior Publication Data
US 2018/0266628 A1 Sep. 20, 2018

(51) Int. Cl.
*F04B 23/02* (2006.01)
*F17C 13/04* (2006.01)
(Continued)

(52) U.S. Cl.
CPC ..... *F17C 13/004* (2013.01); *F04B 23/023* (2013.01); *F17C 13/04* (2013.01);
(Continued)

(58) Field of Classification Search
CPC ..... F17C 1/002; F17C 13/004; F17C 13/04; F17C 2205/0111; F17C 2205/0305;
(Continued)

(56) References Cited

U.S. PATENT DOCUMENTS 1,858,036 A * 5/1932 Brown ..... F04B 9/045 417/251
2,447,467 A * 8/1948 Palm ..... F01B 1/062 417/215

(Continued)

FOREIGN PATENT DOCUMENTS

DE 23 63 471 A1 6/1975
EP 1 347 231 A2 9/2003
EP 1 351 013 A2 10/2003

OTHER PUBLICATIONS

International Search Report (PCT/ISA/210) dated Jun. 7, 2016, by the European Patent Office as the International Searching Authority for International Application No. PCT/FI2015/050644.

(Continued)

*Primary Examiner* — Robert K Arundale
*Assistant Examiner* — Richard K. Durden
(74) *Attorney, Agent, or Firm* — Buchanan Ingersoll & Rooney PC

(57) ABSTRACT

The present invention relates to a fuel tank arrangement of a marine vessel including a fuel tank for Liquefied Natural Gas, the fuel tank having a shell, a heat insulation in connection therewith, connections for a pipeline for bunkering LNG to the fuel tank, a pipeline for taking boil-off gas from the fuel tank and a pipeline for taking LNG from the fuel tank, and a deep well pump for pumping LNG from the tank to the pipeline, wherein at least one recess is extending inwardly from the shell and being arranged on top of the fuel tank, the deep well pump being installed in the at least one recess.

9 Claims, 3 Drawing Sheets

(51) Int. Cl.
*F17C 1/00* (2006.01)
*F17C 13/00* (2006.01)

(52) U.S. Cl.
CPC ..... *F17C 1/002* (2013.01); *F17C 2201/0109* (2013.01); *F17C 2201/035* (2013.01); *F17C 2201/054* (2013.01); *F17C 2203/0333* (2013.01); *F17C 2203/0341* (2013.01); *F17C 2203/0391* (2013.01); *F17C 2203/0617* (2013.01); *F17C 2203/0629* (2013.01); *F17C 2203/0639* (2013.01); *F17C 2203/0643* (2013.01); *F17C 2203/0663* (2013.01); *F17C 2205/018* (2013.01); *F17C 2205/0352* (2013.01); *F17C 2205/0394* (2013.01); *F17C 2221/033* (2013.01); *F17C 2223/0161* (2013.01); *F17C 2223/033* (2013.01); *F17C 2223/043* (2013.01); *F17C 2223/047* (2013.01); *F17C 2225/044* (2013.01); *F17C 2227/0135* (2013.01); *F17C 2227/0393* (2013.01); *F17C 2250/043* (2013.01); *F17C 2250/0408* (2013.01); *F17C 2250/0439* (2013.01); *F17C 2250/0491* (2013.01); *F17C 2260/018* (2013.01); *F17C 2265/032* (2013.01); *F17C 2265/066* (2013.01); *Y10T 137/86348* (2015.04); *Y10T 137/86372* (2015.04)

(58) Field of Classification Search
CPC ..... F17C 2205/0352; F17C 2225/044; F17C 2227/0178; Y10T 137/86348; Y10T 137/86372
USPC ..... 62/47.1, 50.7, 52.1; 141/64; 220/560.11, 220/724, 725, 726, 727, 728
See application file for complete search history.

(56) References Cited

U.S. PATENT DOCUMENTS

| | | | | | |
|---|---|---|---|---|---|
| 2,524,645 | A * | 10/1950 | Abbott | F04B 23/023 | 417/417 |
| 2,609,964 | A * | 9/1952 | Cadwell | F17C 13/04 | 220/724 |
| 2,732,687 | A * | 1/1956 | Brandon | F17C 1/002 | 62/47.1 |
| 3,963,144 | A | 6/1976 | Berwald | | |
| 4,472,946 | A * | 9/1984 | Zwick | F04B 41/02 | 222/385 |
| 4,872,640 | A * | 10/1989 | Schwartz | F16K 1/48 | 251/147 |
| 5,097,976 | A | 3/1992 | Zink et al. | | |
| 5,251,658 | A * | 10/1993 | Zink | B60P 3/2255 | 105/358 |
| 5,386,845 | A * | 2/1995 | Zink | B60P 3/224 | 137/350 |
| 6,637,469 | B2 | 10/2003 | Hoffman et al. | | |
| 6,651,703 | B2 | 11/2003 | Gershtein et al. | | |
| 6,938,654 | B2 * | 9/2005 | Gershtein | F17C 1/14 | 137/350 |
| 2003/0178091 | A1 | 9/2003 | Hoffman et al. | | |
| 2003/0178093 | A1 | 9/2003 | Gershtein et al. | | |
| 2009/0134172 | A1 * | 5/2009 | Gershtein | F17C 13/06 | 220/562 |
| 2017/0037836 | A1 * | 2/2017 | Brown | F04B 23/021 | |

OTHER PUBLICATIONS

Written Opinion (PCT/ISA/237) dated Jun. 7, 2016, by the European Patent Office as the International Searching Authority for International Application No. PCT/FI2015/050644.
International Preliminary Report on Patentability (PCT/IPEA/409) dated Sep. 22, 2017, by the European Patent Office as the International Preliminary Examining Authority for International Application No. PCT/FI2015/050644.

* cited by examiner

FUEL TANK ARRANGEMENT OF A MARINE VESSEL

TECHNICAL FIELD

The present invention relates to a fuel storage tank arrangement in a marine vessel. More particularly, the present invention relates to such an LNG-fuel storage tank arrangement that has the various LNG-connections on top of the fuel tank. The fuel tank arrangement of the present invention covers both LNG-cargo tanks for transporting LNG and LNG-fuel tanks for providing the engine/s of the marine vessel with fuel.

BACKGROUND ART

The use of LNG (Liquefied Natural Gas) as fuel for marine applications is increasing since it is an efficient way of cutting emissions. Within the next few decades, natural gas (NG) is expected to become the world's fastest growing major energy source. The driving forces behind this development are the depleting known oil reserves, increasing environmental care and the continuous tightening of emission restrictions. All major emissions can be significantly reduced to truly form an environmentally sound solution; the reduction in $C0_2$, in particular, is difficult to achieve with conventional oil-based fuels. NG consists of methane ($CH_4$) with minor concentrations of heavier hydrocarbons such as ethane and propane. In normal ambient conditions NG is a gas, but it can be liquefied by cooling it down to −162° C. In liquid form the specific volume is reduced significantly, which allows a reasonable size of storage tanks relative to energy content. The burning process of NG is clean. Its high hydrogen-to-coal ratio (the highest amongst the fossil fuels) means lower $C0_2$ emissions compared with oil-based fuels. When NG is liquefied, all Sulphur is removed, which means zero $SO_x$ emissions. The clean burning properties of NG also significantly reduce NOx and particle emissions compared with oil-based fuels. Particularly in cruise vessels, ferries and so called ro-pax vessels, where passengers are on board, the absence of soot emissions and visible smoke in the exhaust gases of ship's engines is a very important feature.

LNG is not only an environmentally sound solution, but also economically interesting at today's oil prices. The most feasible way of storing NG in ships is in liquid form. In existing ship installations, LNG is stored in cylindrical, single- or double-walled, insulated stainless steel or 9% Ni— steel tanks.

A feature common to such LNG fuel storage tanks is that they are traditionally provided with a so-called dome on top of the tank. All connections between the tank interior and the external fuel systems are located in the tank dome. In other words, the deep well pump used for discharging the LNG from the tank is attached to the dome as well as the connection for bunkering the LNG into the tank, connection for removing the boil-off gas (BOG) and the connection for the LNG-sprays arranged inside the tank. Also a number of valves arranged in connection with the connections may be positioned in the nearhood of the dome above the tank.

What makes the dome extending upwardly from the tank and especially the deep well pump attached to the dome problematic is the space they require in the vertical direction above the tank. The problem appears at its worst in connection with LNG tanks arranged inside a marine vessel between the decks thereof. Sometimes, i.e. when the LNG tanks are on the first deck below the uppermost or main deck, the problem is solved by arranging an opening for the dome and the equipment in connection therewith in the uppermost deck, whereby the pump motor and the rest of the equipment are visible on the uppermost deck.

However, the same practice may not be applied when the LNG tank is positioned, for instance, below the lowermost car deck of a car ferry, but the diameter of the LNG tank has to be reduced such that the dome with the equipment in connection therewith fits between the tank and the deck thereabove. In other words, in this kind of cases the overall height of the LNG fuel tank has to fit between two decks of a marine vessel. In practice, such an arrangement means that the storage volume available for the LNG is significantly reduced as there has to be room left between the top of the LNG tank and the upper deck for the deep well pump, the dome and the connections in connection therewith.

All pipe connections on an LNG storage tanks have to be installed inside a secondary barrier. Secondary barrier is the liquid resisting outer element of an LNG-cargo or LNG-fuel containment system designed to afford temporary containment of any envisaged leakage of liquid fuel or cargo through the primary barrier and to prevent the lowering of the temperature of the ship's structure to an unsafe level. This secondary barrier is typically made of stainless steel. The flows in the various pipelines in connection with prior art LNG fuel storage tanks are controlled by valves that are arranged on the top of the tank or tank's dome inside the secondary barrier, therefore taking additional space in height in order to also accommodate the secondary barrier.

The flows in the various pipelines in connection with prior art LNG fuel storage tanks are controlled by valves that are arranged either on the top of the tank's dome, therefore taking additional space in height, or in a tank connection space at the end of the LNG fuel tank. It means that the pipelines are taken from the dome at the top of the LNG fuel tank to the end thereof in the tank connection space, and in some cases the same fluid that is taken from the dome is returned back to the dome from the tank connection space. In other words, for instance if the LNG in the tank is pumped out of the tank to be returned into the tank via the spray nozzles for temperature control purposes, the LNG is, in accordance with prior art, taken in vain to the tank connection space. Such unnecessary circulation not only increases pumping losses but also increases conveyance of heat in the LNG tank. Additionally, the classification rules require that all shut-off valves have to be installed as close as possible to the tank penetration, which is difficult in prior art.

EP-A2-1351013 discusses a container for holding a solid, liquid and/or gaseous phase product therein and for use within a transportable or stationary support structure. The container maximizes the compressed product volume contained therein and prevents liquid and/or contaminant entrainment during gaseous product delivery from liquid phase product.

U.S. Pat. No. 5,097,976 discusses a fluid containment apparatus including a fluid tank, a well wall and a closure system. The tank has a tank shell, which defines at least in part a fluid containment compartment and has a tank shell opening therethrough. The well wall is secured to the tank shell, positioned at the shell opening, recessed into the fluid containment compartment and defines at least in part a recessed well.

EP-A2-1347231 discusses a system for the transportation and storage of a product comprising a tank including a cylindrical wall section and two ends which define a cylindrical tank periphery, wherein the tank periphery has an interior and an exterior; a recessed valve box including one or more side walls, a bottom wall, and a removable, sealable top cover which can be attached to the one or more side walls to seal the valve box, wherein the valve box side walls are sealably joined to the cylindrical wall section such that the valve box extends through the cylindrical wall section into the interior of the tank periphery and is partially or totally disposed in the interior of the tank periphery; and one or more valves disposed in the valve box.

Thus, in view of a practical aspect, an object of the present invention is to design a novel LNG fuel tank arrangement for a marine vessel, the novel LNG fuel tank arrangement solving the above discussed problems relating to the overall height of an LNG tank and to the positioning of the flow control valves.

Another object of the present invention is to offer a novel LNG fuel tank where the deep well pump used for pumping LNG out of the fuel tank is arranged in a recess arranged at the top of the LNG fuel tank.

A further object of the present invention is to offer a novel LNG fuel tank arrangement where the valves controlling the flow tank are arranged in a recess arranged at the top of the LNG fuel tank.

DISCLOSURE OF THE INVENTION

At least one object of the present invention is substantially met by a fuel tank arrangement of a marine vessel comprising a fuel tank for Liquefied Natural Gas (LNG), the fuel tank comprising a shell, a heat insulation in connection therewith, connections for a pipeline for bunkering LNG to the fuel tank, a pipeline for taking boil-off gas from the fuel tank and a pipeline for taking LNG from the fuel tank, a deep well pump for pumping LNG from the tank to the pipeline, at least one recess extending inwardly from the shell and being arranged on top of the fuel tank, the deep well pump being installed in the at least one recess, the recess having a bottom and a side wall, the deep well pump comprising a pump, a riser and a drive motor, the riser passing through the bottom, wherein the drive motor of the deep well pump is located at least partially inside the recess.

Advantageously, the above discussed fuel tank arrangement allows the installation of the deep well pump and especially its drive motor at least partially within the outer dimensions of the LNG fuel tank, whereby the vertical space required by the deep well pump is reduced. Therefore the need for reducing the diameter of the LNG fuel tank to be able to fit the LNG tank between two decks in a marine vessel is avoided.

BRIEF DESCRIPTION OF DRAWINGS

In the following, the present invention will be described in more detail with reference to the accompanying exemplary drawings, in which.

DETAILED DESCRIPTION OF DRAWINGS

Figures 1A, 1B:
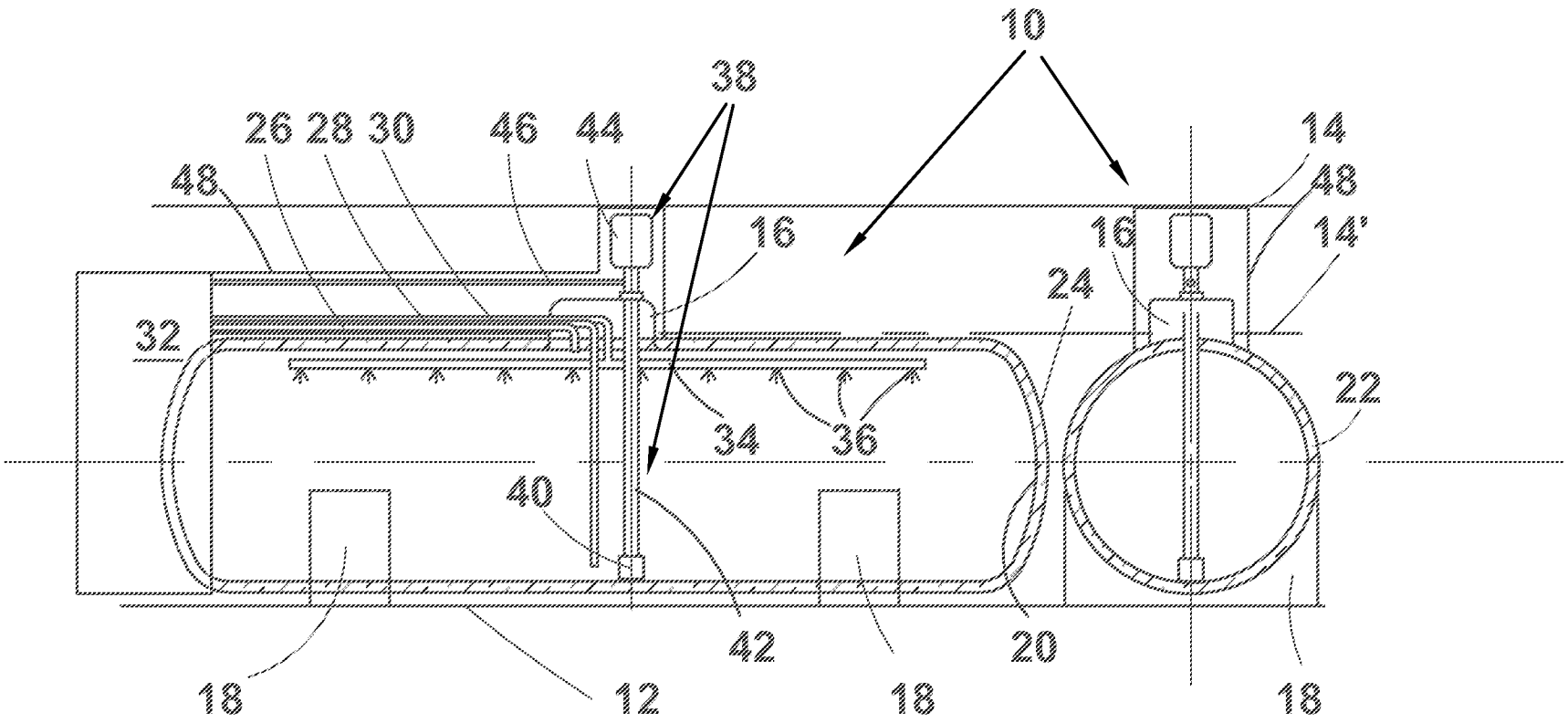
Fig. 1b (Prior Art)
Fig. 1a (Prior Art)
FIG. 1*a* illustrates schematically a longitudinal cross section of a prior art LNG fuel tank.
FIG. 1*b* illustrates schematically a cross section of a prior art LNG fuel tank the cross section being taken perpendicular to the longitudinal axis of the LNG fuel tank.

FIGS. 1*a* and 1*b* illustrate schematically a prior art single-walled LNG fuel tank 10 installed between a lower deck 12 and an upper deck 14 of a marine vessel. Broken line 14' represents an upper deck of such an option that the upper deck may be provided with an opening for the dome 16 of the LNG-fuel tank 10. The LNG fuel tank 10 is installed on the lower deck 12 by means of two or more saddles 18. The single-walled LNG fuel tank has a shell 20, a heat insulation 22 on the outside of the shell 20 and a cladding 24 outside the heat insulation. If the fuel tank is a double-walled tank the heat insulation is between the shells of the fuel tank. Typically, the heat insulation 22 is of the order of 300 mm thick and formed of polyurethane, though also other dimensioning and insulation material may be used. In other words, with a double-walled tank, in addition to ordinary heat insulations, also vacuum or perlite filled vacuum may be used. The cladding 24 outside the heat insulation 22 is for the purpose of protecting the heat insulation from external abrasion, weather etc. The cladding 24 is preferably made of galvanized sheet steel, glassfiber reinforced polyester etc.

On top of the LNG fuel tank 10 a dome 16 projecting radially upward from the shell 20 is provided. The dome 16 is provided with openings in which the pipelines 26, 28 and 30 connecting the interior of the LNG fuel tank 10 to the tank connection space 32 arranged at the longitudinal end of the LNG fuel tank 10. Pipeline 26 is used for removing boil-off gas from the LNG fuel tank, pipeline 28 for bunkering LNG into the LNG fuel tank 10 and pipeline 30 for feeding re-condensed LNG into the LNG fuel tank via a spray header 34 and spray nozzles 36.

The dome 16 is further provided with a deep well pump 38, which is, for example, formed of a centrifugal pump 40 arranged at the lower end of a riser 42 close to the bottom of the LNG fuel tank 10. The deep well pump has further at the upper end of the riser 42 a drive motor 44, normally an electric motor that extends, in practice, 1-2 meters above the dome upper surface, depending on the diameter of the LNG fuel tank 10. The riser 42 between the dome 16 and the drive motor 44 is provided with a pipeline connection 46 for discharging LNG from the fuel tank 10 to the tank connection space 32. The drive 44 of the deep well pump 38, the dome 16 and the pipelines leading from the dome 16 to the tank connection space 32 are enclosed within a secondary barrier 48. The tank connection space 32 may include, among other equipment, valves (not shown) for controlling the flows in the pipelines 26-30 and 46, and a vaporizer for delivering the LNG to be used as a fuel in one or more internal combustion engines of the marine vessel. In another option, when the tank is simply a cargo tank for transporting the fuel the tank connection space does not have the vaporizer, but the pipeline connection 46 is used for unloading the LNG fuel from the tank.

Figures 2A, 2B:
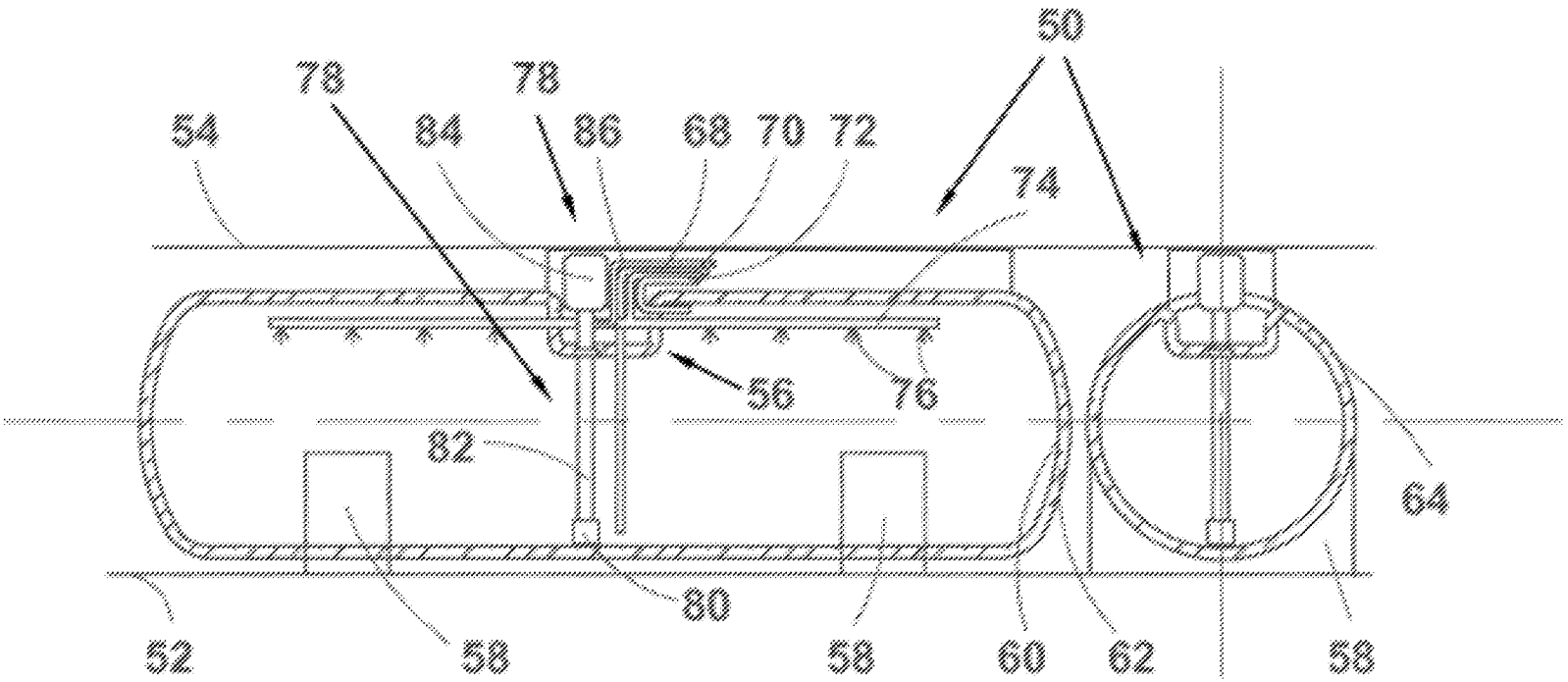
FIG. 2*a* illustrates schematically a longitudinal cross section of an LNG fuel tank in accordance with a preferred embodiment of the present invention.
FIG. 2*b* illustrates schematically a cross section of the LNG fuel tank of FIG. 2*a* the cross section being taken perpendicular to the longitudinal axis of the LNG fuel tank.
Figure 3:
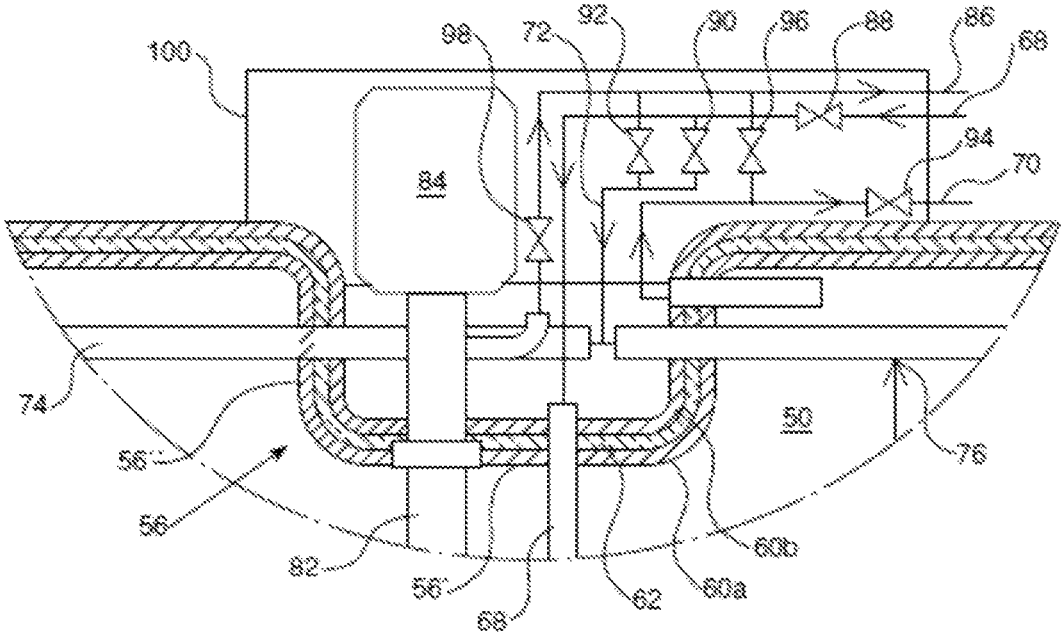
FIG. 3 illustrates schematically a partial longitudinal cross sectional view of the recess of the present invention.

FIGS. 2*a* and 2*b* illustrate schematically a novel LNG fuel tank 50 in accordance with a preferred embodiment of the present invention. The LNG fuel tank 50 of the present invention is of its basic construction similar to the prior art tank of FIGS. 1*a* and 1*b*. The single-walled (or double-walled—see FIG. 3) LNG fuel tank 50 of the invention is, thus, supported on a lower deck 52 of a marine vessel by means of saddles 58. The LNG fuel tank 50 is positioned totally below an upper deck 54 of the marine vessel. As shown in FIGS. 2*a* and 2*b*, the single-walled LNG fuel tank 50 has a shell 60, a heat insulation 62 arranged outside the shell 60 and a cladding 64 provided on the heat insulation 62 for protecting the heat insulation from shocks, abrasion, sunlight, weather etc. The cladding 64 is preferably made of galvanized sheet steel, glassfiber reinforced polyester etc. just to name a few options. Referring to FIG. 3, if the fuel tank is a double-walled tank the heat insulation is between the inner shell 60*a* and the outer shell 60*b* of the fuel tank. The heat insulation itself is known from prior art. The LNG fuel tank 50 of the present invention is also provided with a deep well pump 78 having the centrifugal, or other appropriate, pump 80, the riser 82 and the drive motor 84 and at least four pipeline connections 68-72, and 86 for bunkering LNG into the tank, for removing boil-off gas from the tank, for feeding re-condensed LNG back to the tank, and for removing LNG from the LNG fuel tank, respectively.

However, contrary to the prior art LNG fuel tanks, the LNG fuel tank 50 of the present invention is not provided with a dome extending radially upwardly from the outer shell, but a corresponding recess 56, tub or pool, i.e. a kind of an inverted dome, that provides room for the pipeline connections 68-72 and the deep well pump 78 within the shell 60 of the LNG fuel tank 50.

FIG. 3 illustrates schematically a partial cross sectional view of the "inverted dome" of the present invention. In FIG. 3 it has been shown that the recess has a, preferably but not necessarily, horizontal bottom 56' and a side wall 56". Preferably, the side wall 56" is substantially vertical, but also more or less inclined side wall may be used. The horizontal cross section of the recess 56 may be round but also shapes like elliptical, rectangular or rectangular with rounded corners may, among others, be used. Also when talking about the side wall 56" of the recess 56 the entire circumference of the recess is meant, i.e. even though a rectangular recess may be considered to have four side walls, the term "side wall" used in the present invention covers all side walls of the recess 56. The recess has a depth DI equal to 5-30%, preferably between 5 and 15%, of the diameter of the LNG fuel tank 50.

The recess of FIG. 3 not only contains the pipeline connections but also a number of valves by means of which the flows of various liquids and gases is controlled. In other words, the pipeline 68 introducing LNG to the LNG fuel storage tank 50 is provided with a valve 88 by means of which the LNG flow to the tank 50 is controlled. The spray headers 74 and spray nozzles 76 receive LNG to pipeline 72 from either the bunkering pipeline 68 via a valve 90 or, as a recirculation from the LNG discharge pipeline 86 via a valve 92. The pipeline 70 taking the boil-off gas from the tank 50 is provided with a valve 94 for controlling the gas discharge to the vapour return connection leading to the bunker station or, if necessary, via safety relief valve to atmosphere, and a valve 96 taking the boil-off gas to pipeline 86 leading to the vaporizer (in case the tank used is an LNG-fuel tank used for fueling the engine/s). The LNG discharge line 86 connected to the deep well pump riser 82 passing the heat insulation 62 and the bottom 56" of the shell 60 is provided with a valve 98 for controlling the discharge of the LNG from the LNG fuel storage tank 50. The arrows on each pipeline 68-72 and 86 show the direction of flow in the pipeline.

The above discussed instrumentation, i.e. the pipelines and the valves, has to be arranged within a secondary barrier 100 such that only pipeline 68 for bunkering the LNG, pipeline 70 for discharging the boil-off gas and pipeline 86 for taking the pumped LNG to the vaporizer are taken out of the secondary barrier 100. The discussed instrumentation may fit entirely into the recess 56, it may be partially positioned outside the recess 56, or it may be positioned entirely outside the recess 56. However, preferably at least one of the valves is located inside the recess. Thus the positioning of the instrumentation depends totally on the size, i.e. width and depth of the recess 56. However, it is essential for the operation of the invention, i.e. for solving the problem leading to the present invention, that the deep well pump is arranged in the recess 56. The recess may not necessarily be so deep that the pump (or rather, its discharge connection and drive motor) is totally housed in the recess but, in any case, a substantial share of the vertical height of the deep well pump is fitted in the "inverted dome". In other words, the drive motor is, in accordance with a preferred embodiment of the present invention, located at least partially inside the recess. Thereby the diameter of the LNG fuel storage tank 50 may be, correspondingly, increased when compared to LNG fuel tanks of prior art.

In view of the above it should also be understood that there may be not only one recess at the top of the LNG fuel tank but two or more recesses may additionally be provided. Naturally the recesses may be of different size/s as the one housing the deep well pump is obviously the deepest one, whereas the one/s housing the instrumentation may be shallower.

While the invention has been described herein by way of examples in connection with what are, at present, considered to be the most preferred embodiments of the present invention, it is to be understood that the invention is not limited to the disclosed embodiments, but is intended to cover various combinations or modifications of its features, and several other applications included within the scope of the invention, as defined in the appended claims. It should be understood that the tank arrangement comprises several features which are not shown in figures for the sake of clarity, for example, all such equipment present in each tank arrangement that concern determining pressure, temperature or LNG surface level in the tank has not been shown.

The invention claimed is:

1. A marine vessel fuel tank arrangement, comprising:

a fuel tank having a shell, wherein a top portion of the fuel tank has at least one recess extending inwardly from the shell, the at least one recess having a recess bottom and a recess side wall, wherein:

a portion of the tank that does not have the at least one recess is the tank-proper; and the shell includes an inside shell surface and an outside shell surface, the outside shell surface defining an outer periphery of the tank and the inside shell surface defining an interior of the tank;

a deep well pump having a riser leading to a drive motor, the deep well pump and a first portion of the riser being located within the interior of the tank;

discharge connection instrumentation comprising plural pipeline connections and plural valves, the discharge connection instrumentation operatively connected to the riser;

wherein:

the discharge connection instrumentation, the drive motor, and a second portion of the riser are within the at least one recess and not within the interior of the tank; and a portion of the drive motor extends beyond the outer periphery of the tank-proper;

wherein the interior of the tank is free of structures that would prevent fluid within the tank interior from making contact with the inside shell surface at the recess bottom; and wherein the recess side wall is provided with at least one opening configured to accommodate a spraying means pipeline.

2. The fuel tank arrangement as recited in claim 1, wherein the fuel tank is configured for holding Liquefied Natural Gas (LNG) and the recess side wall is provided with an opening for a pipeline configured for taking boil-off gas from the fuel tank.

3. The fuel tank arrangement as recited in claim 1, wherein the fuel tank is configured for holding Liquefied Natural Gas (LNG) and the fuel tank is provided with a spraying means for spraying LNG into the tank and the spraying means pipeline for introducing LNG to said spraying means.

4. The fuel tank arrangement as recited in claim 1, wherein the fuel tank has a diameter and the at least one recess has a depth equal to 5-30% of the diameter of the fuel tank.

5. The fuel tank arrangement as recited in claim 1, comprising:

a secondary barrier configured to cover at least a portion of the at least one recess.

6. The fuel tank arrangement as recited in claim 1, comprising:

a heat insulation; and a cladding;

wherein the fuel tank is a single-walled fuel tank with the heat insulation disposed on the shell and the cladding disposed on the heat insulation.

7. The fuel tank arrangement as recited in claim 1, comprising:

a heat insulation;

wherein the shell includes an inner shell and an outer shell and the heat insulation therebetween, forming a double-walled fuel tank.

8. The fuel tank arrangement as recited in claim 1, wherein the fuel tank is configured to be installed between a lower deck and an upper deck of a marine vessel.

9. The fuel tank arrangement as recited in claim 1, wherein the fuel tank is configured for transporting Liquefied Natural Gas (LNG) or for storing LNG to facilitate drawing LNG therefrom via a vaporizer to be used as fuel for one or more internal combustion engines of a marine vessel.

* * * * *